US005886670A

United States Patent [19]

Manasson et al.

[11] Patent Number: 5,886,670

[45] **Date of Patent: *Mar. 23, 1999**

[54] ANTENNA AND METHOD FOR UTILIZATION THEREOF

[75] Inventors: Vladimir Manasson, Los Angeles; Lev S. Sadovnik, Irvine, both of Calif.

[73] Assignee: WaveBand Corporation, Torrance, Calif.

[ * ] Notice: The term of this patent shall not extend beyond the expiration date of Pat. No. 5,572,288.

[21] Appl. No.: 698,914

[22] Filed: Aug. 16, 1996

[51] Int. Cl.[6] ..... H01Q 13/00

[52] U.S. Cl. ..... 343/772; 343/785; 333/248

[58] Field of Search ..... 343/767, 770, 343/772, 762, 785, 782, 783, 786; 333/248, 239; 385/37

[56] References Cited

U.S. PATENT DOCUMENTS

| | | | |
|---|---|---|---|
| 4,885,556 | 12/1989 | Lamberty et al. | 343/786 |
| 4,996,535 | 2/1991 | Profera | 343/786 |
| 5,136,304 | 8/1992 | Peters | 343/786 |
| 5,305,123 | 4/1994 | Sadovnik et al. . | |
| 5,572,228 | 11/1996 | Manasson et al. | 343/781 R |
| 5,684,495 | 11/1997 | Dyott et al. | 343/785 |

OTHER PUBLICATIONS

"Radiation Characteristics of a Dielectric Slab Waveguide Periodically Loaded with Thick Metal Strips," Matsumoto et al., *IEEE Transactions on Microwave Theory and Techniques*, vol. MTT–35, No. 2, Feb. 1987, pp. 89–95.

"A Practical Theory For Dielectric Image Guide Leaky–Wave Antennas Loaded By Periodic Metal Strips," Guglielmi et al., *Polytechnic University*, Booklyn New York, U.S.A., pp. 549–554. (The date is not provided).

"Antenna Technology for Millimeter–Wave Applications in Automobiles," Jain, *Hughes.* May 24, 1994, 32 pages.

"MM–wave RADAR for Advanced Intelligent Cruise Control Applications," Tribe et al., *John Langley Lucas Industries, plc, UK*, pp. 9, 10 (M1.1) & 18 (M1.4). (The date is not provided).

"Millimeter–Wave Beam Steering Using 'Diffraction Electronics,'" Seiler et al., *IEEE Transactions on Antennas and Propagation*, vol. AP–32, No. 9, Sep. 1984, pp. 987–990.

WFFB "Millimeter–Wave Technology Application in Automobiles," *1994 IEEE MTT–S International Microwave Symposium*, May 27, 1994, San Diego, CA, Workshop Notes, pp. 1–61.

*Primary Examiner*—Don Wong
*Assistant Examiner*—Tho Phan
*Attorney, Agent, or Firm*—Nilles & Nilles, S.C.

[57] ABSTRACT

Systems and methods for guided wave antennas are described. Apparatus is disclosed comprising: a dielectric nonphotoconductive waveguide defining a principle axis; a grating carrier connected to the dielectric nonphotoconductive waveguide, the grating carrier i) including a photoconductive material and ii) defining a photoconductive axis that is substantially parallel to the principle axis; a spatial light modulator optically connected to the layer of photoconductive material; and a source of illumination optically connected to the spatial light modulator and the layer of photoconductive material. Light from the source of illumination passes through the spatial light modulator and induces a plasma grating in the grating carrier substantially along a direction defined by the photoconductive axis so as to evanescently couple and direct electromagnetic signals traveling in the dielectric nonphotoconductive waveguide, the electromagnetic signals traveling along a direction substantially parallel to the principle axis. The systems and methods provide advantages in that high performance is achieved with a compact package.

15 Claims, 4 Drawing Sheets

ANTENNA AND METHOD FOR UTILIZATION THEREOF

BACKGROUND OF THE INVENTION

1. Field of Use

The present invention relates generally to the field of antennas. More particularly, the present invention concerns scanning antennas. Specifically, a preferred embodiment of the present invention is directed to a photoinduced coupling antenna. The present invention thus relates to antennas of the type that can be termed photoinduced coupling scanning antennas.

2. Description of Related Art

Within this application several publications are referenced by arabic numerals within parentheses. Full citations for these, and other, publications may be found at the end of the specification immediately preceding the claims. The disclosures of all these publications in their entireties are hereby expressly incorporated by reference into the present application for the purposes of indicating the background of the invention and illustrating the state of the art.

Vehicle crashes represent a significant public health hazard as well as a cause of significant economic loss each year. Therefore, there has been a long felt need for an inexpensive crash avoidance system for use in automobiles, aircraft and other vehicles.

The National Highway Traffic Safety Administration (NHTSA) has identified Autonomous Intelligent Cruise Control (AICC) and similar autonomous crash avoidance systems as precursors to fully automated driving in the proposed future Automated Highway System. Highway crashes are the sixth leading cause of death in the USA, and the major cause of death for people below the age of 25. A recent NHTSA report gives the costs associated with the 44,531 deaths, 5.4 million injuries, and 28 million damaged vehicles in 1990; the losses are estimated to be $137.5 billion in lost wages and other direct costs. The economic loss from traffic crashes represents greater than 2% of the U.S. GNP, and results in nearly 2 billion hours of lost time and 7.5 million liters of wasted fuel each year. Aircraft, and other vehicle, crashes also represent a significant economic loss each year.

Crash avoidance systems (CAS) for highway vehicles are conventionally designed to be a countermeasure to one or more classes of recognized crash types. Crash avoidance systems generally fall into three categories: near obstacle detection systems (NODs), forward looking radar (FLR) systems, and wide angle imaging systems for all weather and night vision (AWNV).

The clear choice of wavelength for FLR and AWNV sensors is the millimeter wavelength (MMW) range. The European frequency allocation for such sensors is 76 to 77 GHz. The Japanese frequency allocation for such sensors is currently 59 to 60 GHz. The U.S. frequency allocation for such sensors, while still under discussion, has tended to be around 76 to 77 GHz, although 94 GHz has also been discussed. The electronic and signal processing parts of FLR and AWNV systems are considered to be essentially developed and ready for mass production.

For example, millimeter wavelength transceiver electronic packages for use in conjunction with the crash avoidance systems for vehicles such as, for example, automobiles are already commercially available. A specific example of such a commercially available transceiver electronic package is Litton's millimeter wavelength transceiver.[2]

However, an inexpensive scannable millimeter wavelength antenna is not yet commercially available for use with such crash avoidance systems. As a practical economic matter, the phase shifting element solution used for prior art seeker applications cannot be adopted for use in a commercial vehicle crash avoidance system because of the extremely high cost of the individual phase shifting elements that are a part of such seeker applications, (i.e., from approximately $2,000 to approximately $10,000). Further, the phase shifting element solution used for prior art seeker applications cannot be adopted for use in a commercial vehicle crash avoidance system because of the very high cost of the skilled hand labor required for the assembly of such a phased array antenna.

An IEEE workshop in May 1994[1] on millimeter wavelength technology for automobiles identified the millimeter wavelength scanning antenna as a key element needed to complete an economically viable automobile crash avoidance system. However, of more than 30 existing antenna technologies previously studied, none satisfies the full range of required parameters, especially the possibility of being mass produced at very low cost.

A millimeter wavelength scanning antenna that is economically feasible for use in automobiles would probably be feasible for use in more expensive vehicles such as, for example, aircraft. A commonly accepted cost for an economically feasible forward looking millimeter wavelength antenna for an automobile is presently approximately $50. Clearly, the existing antennas that are used for prior art seeker applications cannot be manufactured at such a low cost. Therefore, there has been a long felt need for a low cost millimeter wavelength scanning antenna.

The availability of a low cost millimeter wavelength scanning antenna would make an inexpensive automobile crash avoidance system a commercial reality. Such a low cost millimeter wavelength scanning antenna could also be used to provide an inexpensive aircraft, or other vehicle, crash avoidance system.

The below-referenced U.S. patent discloses embodiments that are satisfactory for the purposes for which they were intended but which have certain disadvantages. The disclosure of the below-referenced prior United States patent in its entirety is hereby expressly incorporated by reference into the present application.

U.S. Pat. No. 5,305,123 discloses a light controlled spatial and angular electromagnetic wave modulator. In embodiments disclosed in the above-referenced prior patent, periodic perturbations of the complex dielectric field in the surface of a semiconductor material induced by an optical control pattern cause electromagnetic waves to be coupled out of the semiconductive material in a particular direction depending upon the period of the perturbations. Rapid variations in the period of the perturbations can be induced by controlling the optical control pattern. By rapidly changing the period of the perturbations, (i.e., the grating period induced by the optical control pattern), can be used to control the direction of beam steering and forming can be achieved.

Light can change the complex refractive index n of a semiconductor material. Specifically, n=n (I) where n=n'+in" (where n' and in" are the real and imaginary parts respectively and and I is the intensity of the optical wave. The mechanics of this phenomenon is based on fundamental Drude theory. See T. S. Moss, "Optical Properties of Semiconductors," Butterworths, London (1959).

The intensity I of an optical wave can change the complex refractive index of Si, GaAs, InGaAsP and other semiconductors in the microwave range (1 mm–1 cm) and infrared (IR) range (1.0$\mu$–100$\mu$). See I. Shih, "Photo-Induced Complex Permittivity Measurements of Semiconductors" 477 SPIE 94 (1984) (microwave range) and B. Bennett, "Carrier-Induced Change in Refractive Index of InP, GaAs, and InGaAsP" 26 IEEE J. Quan. Elec. 113 (1990) (IR range) incorporated herein by reference.

The prior art shows light induced modulation of both the real and imaginary parts of the refractive index. The real part controls phase and the imaginary part controls amplitude of the modulated electromagnetic field. The real part is primarily responsible for changes in IR waves and the imaginary part for changes in millimeter waves (MMW). This effect is described by Drude theory and involves carrier induced changes in the complex permittivity of metals and semiconductors when illuminated by light. Light increases the density of free carriers in the material.

Based on this effect, devices which change the phase of lightwaves by illumination of semiconductors with other light have been developed. Specifically, optical phase modulators have been employed. In the state of the art, however, it is shown possible to modulate the material at only one point. This type of limited modulation is discussed in a recent article by Z. Y. Cheng and C. S. Tsai "Optically Activated Integrated Optic Mach-Zender Interferometer on GaAs," 59 Appl. Phys. Lett. 1991. It would be beneficial to employ a device that can modulate an EM field at more than one point, particularly to modulate the material in two dimensions (2D) and potentially three dimensions (3D).

At the same time, optically controlled spatial light modulators (SLM) based on semiconductor materials have been used. In optically addressed SLMs, the semiconductor plays a transport role, such that changes in the semiconductor material affect an adjacent layer of electro-optic (EO) material which in turn affects an EM wave propagating through the EO material. The effectiveness of this type of modulator is low. It should be mentioned that these devices are limited to controlling the visible range only.

These SLM devices transmit or project some 2D pattern which can be transmitted through an optical wave. Other types of devices that are of interest, however, transmit EM waves in a particular direction in the microwave region without moving parts. Such devices are called phased array antennas.

A phased array is a network of radiating elements, each of which is usually non-directive but whose cooperative radiation pattern is a highly directed beam because constructive interference occurs between radiating elements. Whereas previous radar antennas had to be mechanically steered for beampointing, the phased array antenna achieves the same effect electronically by individually changing the phases of the signals radiating from each element. Narrow angular band beams can be formed by simply driving each element of the array with an appropriately phased signal. Moreover, electronic steering is much faster and more agile than mechanical beam steering and can form several beam lobes and nulls to facilitate multiple target tracking or other functions such as anti-jamming.

The flexibility of electronic steering afforded by phased array radars, however, comes at the cost of individual control of each element. The N elements of the antenna are driven with the same signal but each with a different phase. In practice, a single signal is equally split into N signals to feed the elements, and a phase shifting network, such as those using ferrites or diodes, is provided for individual phase control of each element. For large arrays (i.e., N>100), the complexity of the power splitting network and the cost of providing N phase shifters can become quite high, not to mention the bulkiness of the necessary waveguide plumbing. Moreover, for very large arrays, the computation required to calculate the array phase distribution for a desired radiation pattern is a serious burden. These constitute the most serious drawbacks of conventional phased array radar systems.

Phased array antenna theory is based on Fourier optics in general and the theory of diffraction gratings in particular. It is well known from Fourier optics that the optical beam is diffracted in a particular direction if the phase difference between the particular optical rays is a multiple of the wavelength of the optical beam.

The phase synchronized condition has the form $m\lambda=\Lambda\sin\theta$, where $\Lambda$ is the grating constant, $\theta$ is the angle of diffraction, and m is the integers 0, ±1, ±2 . . . From this equation we obtain the following equation $$\sin\theta = m \cdot \frac{\lambda}{\Lambda} \qquad \text{(Eq. A)}$$

which is the well known grating equation. If electrically controlled, a phase shift of $m\lambda$ can be introduced between different antennas thereby causing constructive interference in one direction, which results in antenna directionality. This effect can be used in both a transmitter and a receiver.

Exactly the same principle is used in conventional phased array antennas where illuminated points of the gratings are replaced by elementary antennas. See M. I. Skolnik, "Introduction to Radar Systems", McGraw Hill N.Y. (1980) incorporated herein by reference.

Using Equation A two basic disadvantages of phased array antenna systems are made apparent: (1) the periodic structure has a discrete point-type profile. This means that many diffraction orders are generated; only one order is desired, and the remaining orders reduce efficiency of the system; (2) the number of elementary antennas is limited by size and complexity. As the frequency of the microwaves increase (beyond 60 GHZ), the density of packaging of individual elements and phase shifters limits the feasibility of such an antenna. Also, having individual emitters fixed in space precludes the antenna from being used for different frequencies. At the receiver end, such an antenna has limited bandwidth capability (due to the fixed elements).

For IR beam steering the packaging of individual phase shifters is virtually impossible and an electronically controlled spatial light detector is limited to very narrow angular bandwidth. See F. Vasey et al., "Electro-optic AlGaAs Spatial Light Deflector/Modulator Based on a Grating Phased Array" 58 Appl. Phys. Lett. 2874 (1991) incorporated herein by reference.

SUMMARY OF THE INVENTION

By way of summary, the present invention is directed to a guided-wave antenna induced by light (GAIL). An unexpected beneficial effect of the present invention, which is a substantial improvement, is to provide a high level of performance in a compact package.

A primary object of the invention is to provide a guided wave antenna with a high gain. Another object of the present invention is to provide a scanning antenna with a high scanning rate. A further object of the present invention is to provide a scanning antenna that is inexpensive to fabricate. It is still another object of the present invention to provide a scanning antenna with a well defined beam pattern. Yet another object of the invention is to provide an apparatus that is cost effective. It is another object of the invention is to provide an apparatus that is rugged and reliable, thereby decreasing down time and operating costs. Yet another object of the invention is to provide an apparatus that has one or more of the characteristics discussed above but which is relatively simple to manufacture and assemble using a minimum of equipment.

In accordance with a first aspect of the invention, these objects are achieved by providing an apparatus comprising a photoconductive waveguide defining a principle axis; a spatial light modulator optically connected to said photoconductive waveguide; and a source of illumination optically connected to said spatial light modulator and said photoconductive waveguide, wherein light from said source of illumination passes through said spatial light modulator and induces a plasma grating in said photoconductive waveguide along a direction substantially parallel to said principle axis so as to evanescently couple and direct electromagnetic signals traveling in said photoconductive waveguide, said electromagnetic signals traveling along a direction substantially parallel to said principle axis. In a variation of this embodiment, a detector is connected to said photoconductive waveguide so as to receive said electromagnetic signals from said photoconductive waveguide.

Another object of the invention is to provide a method that can be used to operate the antenna. It is another object of the invention is to provide a method that is predictable and reproducible, thereby decreasing variance and operating costs. It is yet another object of the invention to provide a method that has one or more of the characteristics discussed above but which is relatively simple to setup and operate using moderately skilled workers.

In accordance with a second aspect of the invention, these objects are achieved by providing a method comprising providing a guided-wave antenna with: a) a dielectric nonphotoconductive waveguide defining a principle axis; b) a grating carrier connected to said dielectric nonphotoconductive waveguide, said grating carrier i) including a photoconductive material and ii) defining a photoconductive axis that is substantially parallel to said principle axis; c) a spatial light modulator optically connected to said layer of photoconductive material; and d) a source of illumination optically connected to said spatial light modulator and said layer of photoconductive material; and illuminating said grating carrier with light from said source of illumination that passes through said spatial light modulator so as to induce a plasma grating in said grating carrier substantially along a direction defined by said photoconductive axis, said plasma grating having a period; evanescently coupling electromagnetic signals traveling in said dielectric nonphotoconductive waveguide, said electromagnetic signals traveling substantially along a direction defined by said principle axis; and directing electromagnetic signals traveling in said dielectric nonphotoconductive waveguide. In a variation of this embodiment, the method also includes modulating said spatial light modulator so as to scan said antenna by changing said period.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications.

BRIEF DESCRIPTION OF THE DRAWINGS

The advantages and features of the present invention will become more readily apparent with reference to the detailed description which follows and to exemplary, and therefore non-limiting, embodiments illustrated in the following drawings in which like reference numerals refer to like elements and in which:

FIG. 8(*b*) illustrates plasma density as a function of position in an antenna according to the second embodiment of the present invention.

FIG. 9(*b*) illustrates plasma density as a function of position in the antenna according to the second embodiment of the present invention.

DESCRIPTION OF PREFERRED EMBODIMENTS

Figure 1:
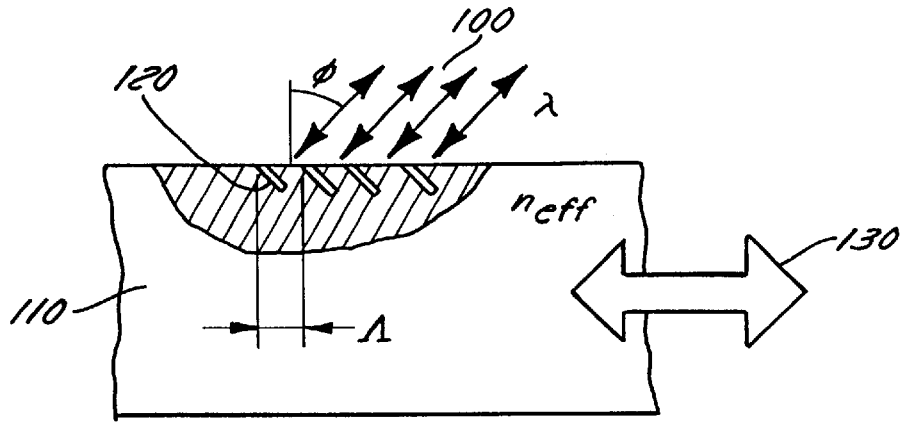
FIG. 1 illustrates a schematic view of the principle of operation of a guided-wave antenna induced by light according to the present invention.

The present invention and various aspects, objects, advantages, features and advantageous details thereof are explained more fully below with reference to exemplary, and therefore non-limiting, embodiments described in detail in the following disclosure and with the aid of the drawings. In each of the drawings, parts the same as, similar to, or equivalent to each other, are referenced correspondingly.

In the present invention, electromagnetic waves are coupled into and/or out-of a waveguide in a guided direction that is a function of the period of perturbations in the complex dielectric permittivity imposed on, in, or near the surface of the waveguide. Further, the guided direction can be varied in response to changes in the periodicity of the perturbations. A guided wave antenna in accordance with the present invention is thereby provided with the ability to scan.

Referring to the drawings, it can be seen that the present invention can use inexpensive components. Pursuant to the present invention, preferred embodiments can have a low manufacturing cost because no fine tuning of the finished product is required.

In a preferred embodiment according to the present invention, electromagnetic waves are coupled into and/or out-of a dielectric waveguide using a light induced grating coupler that is imposed in a photoconductive layer. The term photoconductive, as used herein (and conventionally understood), is defined as photosensitive, (i.e., the property of conducting current under illumination). Thus, the term nonphotoconductive, as used herein, is defined as nonphotosensitive, (i.e., the property of current conductivity that is independent of illumination). Rapid changes of the grating period of the light induced grating coupler, which can be obtained by changing an imposed signal, provides a guided-wave antenna induced by light (GAIL) that has the ability to scan.

Referring to FIG. 1, a schematic view of the principle of operation of a guided-wave antenna induced by light according to the present invention is shown. Input/output millimeter wavelength beams 100, are coupled with millimeter wavelength semiconductor waveguide 110, by optically induced waveguide coupler 120. Millimeter wavelength semiconductor waveguide 110, is preferably made of silicon. The coupled input/output millimeter wavelength beams 100, are then directed toward a detector or away from a millimeter wavelength source along principle axis 130. It is not necessary that the entire waveguide be fabricated from a semiconductor material. Further, for example, although the optically induced waveguide coupler 120, requires a suitable semiconductor material in order to be optically induced, the optically induced waveguide coupler 120 can be generated in a photoconductor layer that is deposited on a separate dielectric, nonphotoconductive waveguide through which coupled millimeter wavelength beams are directed toward a detector or away from a millimeter wavelength source. A guided-wave antenna induced by light in accordance with this preferred embodiment of the invention advantageously includes a separate photoconductor layer, a separate single mode nonphotoconductive waveguide and a light pattern generator which will introduce periodic variations of the complex dielectric permittivity into the photoconductor layer. As a result, electromagnetic signals, for example millimeter wavelength radiation, will be coupled out of the nonphotoconductive waveguide in a controlled direction. This direction can be changed rapidly to scan the antenna beam. In the receiving mode, the incoming electromagnetic signals, for example millimeter wavelength radiation, will be preferentially coupled into the waveguide from a particular direction.

While not being bound by theory, the equation governing the direction of the input/output beam is $\sin\emptyset = n_{eff} - \lambda/\Lambda$ where $n_{eff}$ is the effective refractive index of a waveguide (the ratio of the waveguide and free space propagation constants). Thus, rapidly changing the induced grating period $\Lambda$, scans the antenna beam and, if desired, steers it in any direction of interest.

The grating pattern induced onto the waveguide can be changed rapidly using commercially available spatial light modulators. Among them, the most practical spatial light modulators are the type of liquid crystal displays that are already used in computers and televisions. Liquid crystal displays are available in various sizes and can be customized to fit the guided-wave antenna induced by light design.

The development of the present invention can benefit crash avoidance systems by offering a lightweight, inexpensive antenna that can be manufactured using standard semiconductor processing technology without the need for hand fabrication or adjustment. A guided-wave antenna induced by light according to the present invention has no high density packaging problems because there are no phase shifters.

The present invention can benefit crash avoidance systems by offering a guided-wave antenna induced by light having operation over the full W-band (60 to 140 GHz) with linear performance. This may improve FMCW Doppler ranging. A discrete element array would require higher emitter packaging density with increased frequency.

Further, the present invention can benefit crash avoidance systems by providing wide field-of-view coverage of up to ±60° in azimuth. The present invention can provide agile tracking capability, (e.g., 1 kHz track measurement rate over the entire field-of-view). The present invention offers a very compact antenna design.

Moreover, the use of semiconductor material will yield a fully integrated antenna utilizing MMIC technology, with the Schottky diode detector and the Gunn oscillator source fabricated as part of the waveguide using, for instance, a V-coupler.

Figure 2:
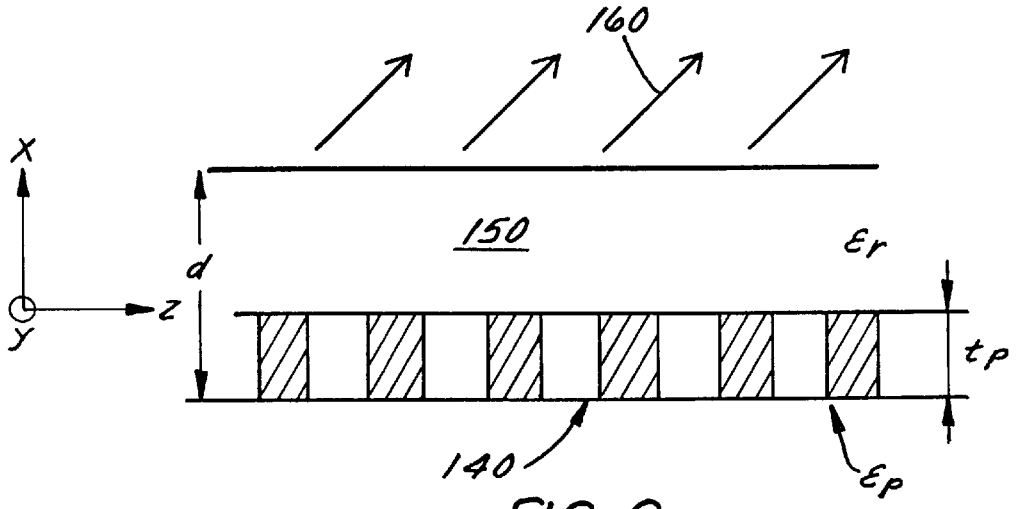
FIG. 2 illustrates a schematic view of the geometry of a photoinduced grating coupler according to the present invention.

Referring now to FIG. 2, a schematic view of the geometry of a photoinduced grating coupler according to the present invention is shown. In this embodiment, a photoinduced grating 140, is depicted as being induced within a semiconductor 150. Millimeter wavelength beams 160, are shown as exiting semiconductor 150.

To simplify the theoretical description of the guided-wave antenna induced by light, we assume that the photoinduced grating is localized in a thin region within the waveguide, as shown in FIG. 2. We also assume that the fields have no variations in the y direction and have a propagation factor of exp $(-j\beta z)$ in the z direction. The lower surface of the semiconductor slab is illuminated with above-band-gap radiation. Complex permittivity of the plasma-induced region $0<x<t_p$ is given by:

$$\epsilon_p = \epsilon_r - \left[ \frac{\omega_e^2}{\omega^2 + \nu_e^2}\left(1 + j\frac{\nu_e}{\omega}\right) + \frac{\omega_h}{\omega^2 + \nu_h^2}\left(1 + j\frac{\nu_h}{\omega}\right)\right] \quad \text{Eq. (1)}$$

where $\omega_{e,h} = (ne^2)/(\epsilon_0 m_{e,h})$ and N, e, $\epsilon_0$, $V_e$, h and $m_{e,h}$ are electron-hole plasma density, the elementary charge, free space permittivity, collision frequency (inverse to the pulse relaxation time), and carrier effective mass for electron and hole, respectively[5]. For silicon $\epsilon_r = 11.8$, $v_e = 4.53\times10^{12}\ s^{-1}$, $v_h = 7.71\times10^{12}\ s^{-1}$, $m_e = 0.259\ m_0$ and $m_h = 0.38\ m_0$ ($m_0$ is the electron rest mass)[6].

Figure 3:
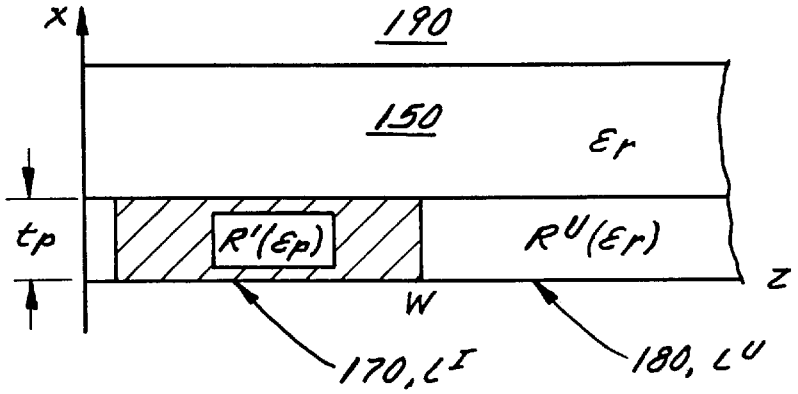
FIG. 3 illustrates a schematic view of a single period of a photoinduced grating according to the present invention.

Referring now to FIG. 3, a schematic view of a single period of a photoinduced grating according to the present invention is shown. Illuminated region 170, is adjacent unilluminated region 180. Semiconductor 150 has an interface with air 190, opposite illuminated region 170 and unilluminated region 180. For a single grating period, as shown in FIG. 3, where illuminated and unilluminated regions are denoted by $R^I$ and $R^U$, respectively, the boundary-integral equation governs the fields inside the grating layer.

$L^I$ and $L^U$ are the contours enclosing regions $R^I$ and $R^U$ respectively. The integral equations to be solved for TE polarizations in this task are[7]

$$\frac{1}{2} E_y(r^I) = \oint_{L^I} \left( \Psi^I \frac{\partial E_y}{\partial_n} - E_y \frac{\partial \Psi^I}{\partial_n} \right) dl \text{ for } R^I \quad \text{Eqs. (2)}$$

-continued $$\frac{1}{2}E_y(r^U)=\int_{L^U}\left(\Psi^U\frac{\partial E_y}{\partial_n}-E_y\frac{\partial\Psi^U}{\partial_n}\right)dl \text{ for } R^U$$

Here, $r^I$ is a radius vector at a point on $L^I$, $\partial/\partial n$ is the outward normal derivative on $L^I$, and $\psi^I$ is Green's function in the respective region (i=I,U).

Solving these boundary-integral equations will determine grating coupling efficiency and maximize it as a function of the geometrical parameters W, and $t_p$, and the required illumination level will be found. Defining these parameters as well as the limitations of the proposed approach will constitute a necessary step in the development of the guided-wave antenna induced by light.

Figure 7:
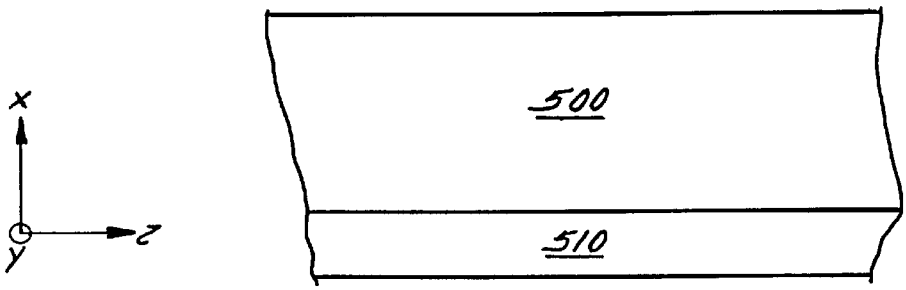
FIG. 7 illustrates a schematic view of an antenna according to a second embodiment of the present invention.

Referring now to FIG. 7, a schematic view of an embodiment of the present invention is shown. Dielectric nonphotoconductive waveguide 500 is optically connected to, and adjacent, photoconductive layer 510. Dielectric nonphotoconductive waveguide 500 is not photosensitive. In contrast, photoconductive layer 510 is photosensitive and functions as a grating carrier. Grating inducing light is incident upon photoconductive layer 510 in the direction indicated by the positive X-axis of FIG. 7.

Dielectric nonphotoconductive waveguide 500 can be made from dielectric materials that are transparent at millimeter wavelength frequencies, such as, for example, quartz (i.e., $SiO_2$), sapphire (i.e., $Al_2O_3$), teflon (i.e., polytetraflouroethylene) or silicon doped with gold (i.e., Si:Au). The gold impurity in the silicon sharply drops the photoconductivity of the silicon and thus prevents forming of any photoconductive grating inside the dielectric nonphotoconductive waveguide 500. On the contrary, photoconductive layer 510 should be made from a pure semiconductive material, such as, for example, float-zone silicon. In this structure with two distinctly different photoconductive/nonphotoconductive materials, the photoinduced grating is confined within the semiconductor layer (photosensitive layer 510) and has a very small affect on absorption of millimeter wavelength energy propagating along the dielectric nonphotoconductive waveguide 500.

If both dielectric nonphotoconductive waveguide 500 and photoconductive layer 510 are made from the same type of crystal, for example, gold doped silicon and undoped float-zone silicon, then millimeter wavelength energy propagating through dielectric nonphotoconductive waveguide 500 has a smaller reflection from the interface between the two materials and this energy is strongly defracted by the photoinduced grating. Other pairs of materials with close dielectric constants at millimeter wavelength frequencies can be used as well, such as, for example, sapphire and undoped silicon.

Figure 8A:
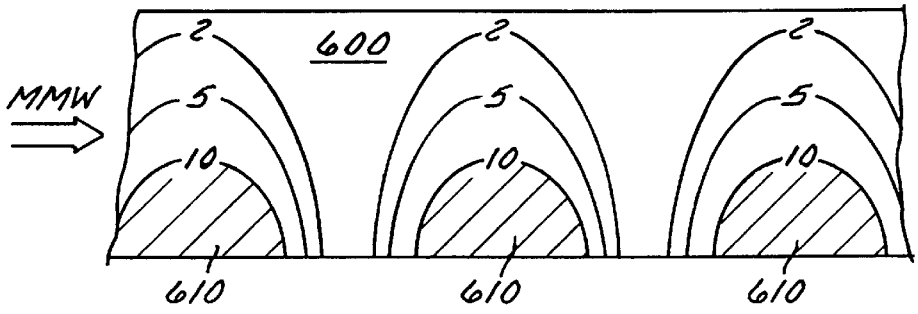
FIG. 8(*a*) illustrates a schematic view of photoinduced plasma within an antenna according to the first embodiment of the present invention.
Figure 8B:
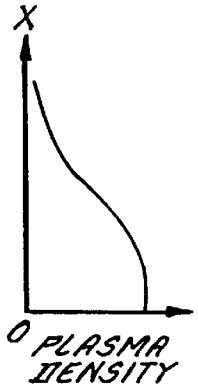
Figure 9A:
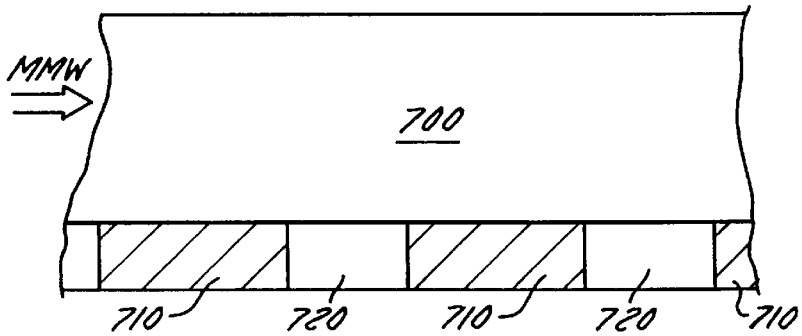
FIG. 9(*a*) illustrates a schematic view of photoinduced plasma within an antenna according to the first embodiment of the present invention.
Figure 9B:
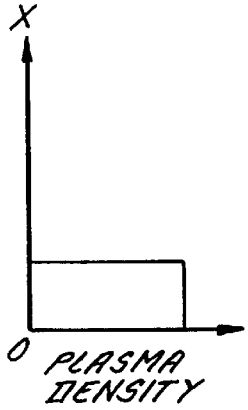

FIGS. 8*a*–8*b* and 9*a*–9*b* illustrate the difference between photoinduced changes in entirely photoconductive waveguides (FIGS. 8*a*–8*b*) and in dielectric waveguides with an adjacent layer made from a different material (FIGS. 9*a*–9*b*). Referring now to FIG. 8*a*, millimeter wavelength energy is traveling through waveguide 600 in a plane that is defined by waveguide 600. Waveguide 600 is made entirely from a photoconductive material that is photosensitive. A volumetric grating defined by photoinduced plasma 610 is represented by iso-gradients labeled with relative concentration index numerals 10, 5 and 2. It will be noted that the photoinduced plasma extends substantially into waveguide 600 along a direction parallel to the grating inducing light, albeit with decreasing density. Referring now to FIG. 8*b*, plasma density as a function of distance from the light incident surface of waveguide 600 can be appreciated.

Referring now to FIG. 9*a*, millimeter wavelength energy is traveling through waveguide 700 along a plane defined by waveguide 700. However, in this embodiment, waveguide 700 includes gold doped silicon. Therefore, waveguide 700 is nonphotoconductive. Grating carrier 720 is connected to, and adjacent, waveguide 700. Grating carrier 720 is photoconductive because it is made of a material that is substantially pure silicon. Therefore, grating carrier 720 is a photoconductive layer that is photosensitive while waveguide 700 is a nonphotoconductive material that is nonphotosensitive. Photoinduced plasma 710 defines a volumetric grating within grating carrier 720. It will be appreciated that photoinduced plasma 710 does not cross the interface between waveguide 700 and grating carrier 720. Referring to FIG. 9*b*, plasma density as a function of distance from the incident surface of grating carrier 720 can be seen.

In summary, in the case of the embodiment depicted in FIGS. 8*a*–8*b*, the plasma defuses from the place it was generated across the whole waveguide and blocks propagation of millimeter wavelength energy. Conversely, in the case of the embodiment illustrated in FIGS. 9*a*–9*b*, the plasma is confined within the photoconductive material layer and absorbs much less millimeter wavelength energy.

Figure 4:
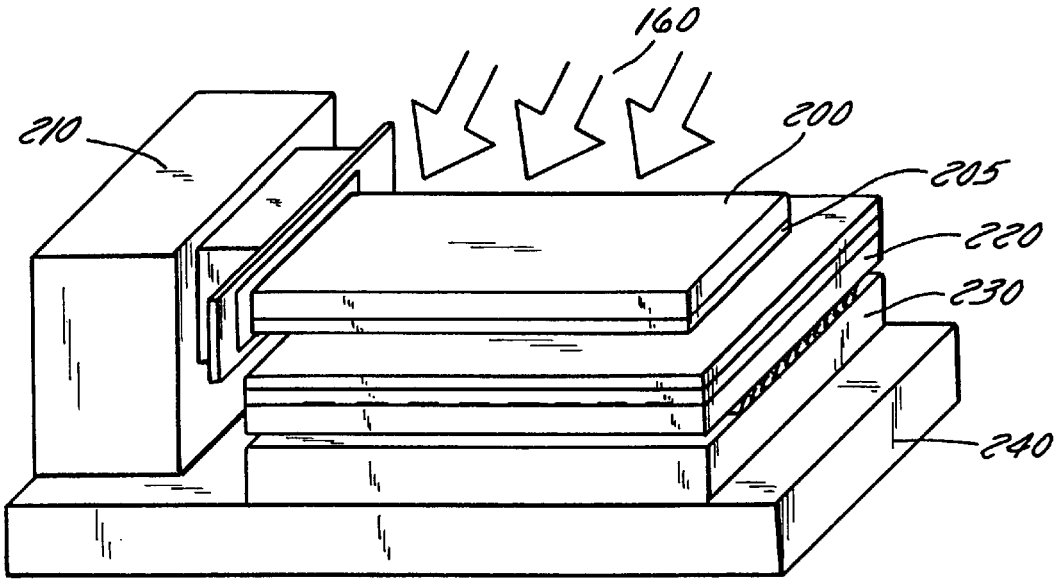
FIG. 4 illustrates a isometric schematic view of an antenna according to an first embodiment of the present invention.

Referring now to FIG. 4, a schematic view of an antenna according to the present invention is shown. A millimeter wavelength detector, not shown in FIG. 4, is coupled with a single mode silicon waveguide 200, through a WR10 port 210. Alternatively, a separate single mode millimeter wavelength waveguide that is nonphotoconductive and which is coupled through the WR10 part 210, can be provided on top of a separate photoconductive layer. A grating pattern is induced in the silicon waveguide 200 by a computer-controlled spatial light modulator 220 (SLM) and a source of illumination 230, (such as, for example, a light emitting diode array). There is preferably a layer of indium-tin oxide 205 between spatial light modulator 220, and the silicon waveguide 200. Source of illumination 230 is connected to base 240. The silicon waveguide 200, which functions as a grating carrier, is designed to couple the millimeter wavelength energy into and out of the silicon waveguide 200 and to form an appropriate beam pattern. Changing the optically induced grating period steers the beam. The antenna is fully reversible, and can operate in receiving as well as transmission mode, responding only to a signal coming from a particular direction. Integration of the transmitter and the receiver into a single antenna is envisioned. The radiative modes generated at the perturbation in the periodic surface radiate from both surfaces. To prevent back radiation, a ground plane can be used. ITO can be used as a shielding material. Because of its high conductivity, the ITO shield will effectively reflect millimeter wavelength radiation, acting as a metal ground plate. The high transparency of ITO in the visible and near IR allows the silicon slab to be illuminated through the shield, simplifying the design of the antenna.

The ITO film can serve as a very effective antireflection coating in the visible and IR regions of the spectrum. Therefore, the use of an ITO shield can optimize the pumping power and eliminate multireflection effects that commonly distort the illuminating pattern.

The thickness of the ITO layer is critical. When ITO layer thickness is excessively low, the effectiveness of the ITO layer as a ground plane effect is reduced. On the other hand, when ITO layer thickness is excessively high, the effectiveness of the ITO layer in transmitting the control pattern is reduced.

Figure 5:
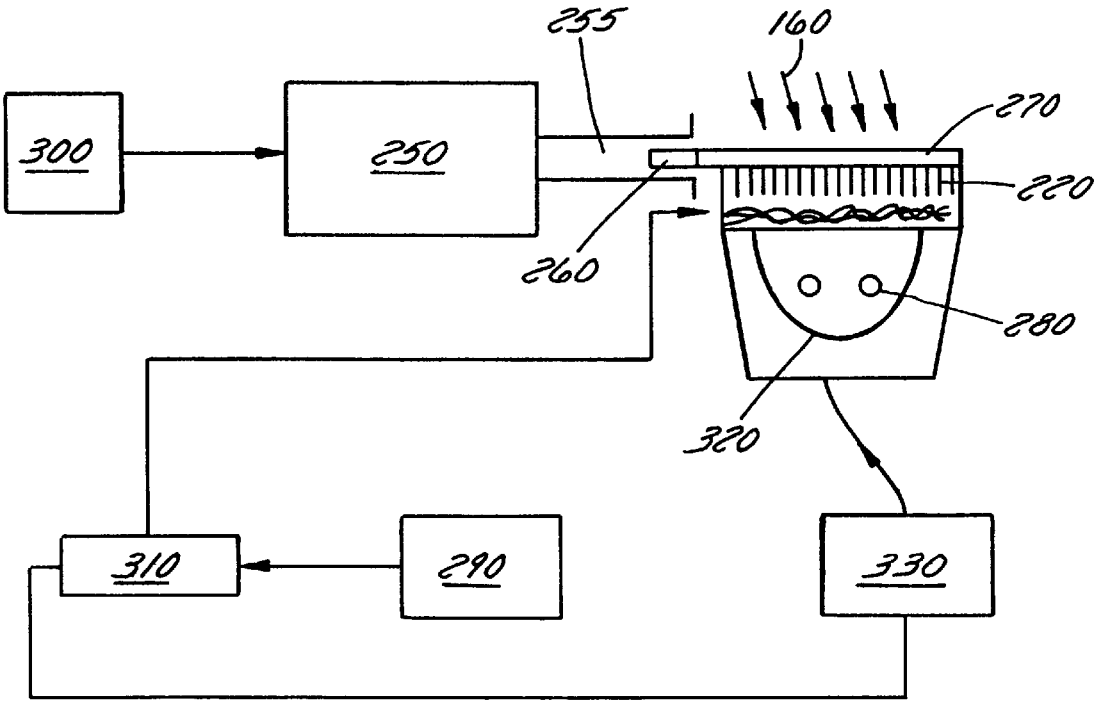
FIG. 5 illustrates a schematic view of an exemplar optically controlled antenna system according to the first embodiment of the present invention.

Referring now to FIG. 5, a schematic view of an optically controlled antenna system according to the present invention is illustrated. The antenna can include a Schottky diode 250, with a coupled metal waveguide 255, such as, for example, a WR10. A tapered end 260 of a silicon slab waveguide 270 is inserted into the metal waveguide 255. Tapering helps to prevent back reflectance. A xenon flashlamp 280, illuminates an indium-tin oxide (ITO) coated surface of the silicon slab waveguide 270 through spatial light modulator 220. Spatial light modulator 220 serves as a grating pattern generator. Its operation, as well as that of the xenon flashlamps 280, are controlled by a computer 290, preferably a compact microprocessor. Power source 300, is connected to Schottky diode 250. Schottky diode 250 is preferably equipped with a resonator. Computer 290 is connected to the rest of the apparatus through interface 310. Xenon flashlamps 280 are located within a reflector 320. Xenon flashlamps 280, are powered by pulse generator 330. The light patterns on the silicon surface are thus controlled by the functions that are computer-generated in SLM 220. As a result, a periodic grating will be generated within the silicon slab waveguide 270, and this grating will couple millimeter wavelength radiation in a direction determined by the period (i.e., the direction represented by millimeter wavelength beams 160).

In a preferred embodiment, the SLM to be used is a liquid crystal display (LCD) that is based on a pneumatic-field effect liquid crystal cell. Such a liquid crystal material can be sandwiched between two glass substrates coated with transparent electrodes. The two substrates are oriented such that the liquid crystal alignment at one surface is perpendicular to that at the other surface.

The intersection of transparent row and column electrodes defines individual pixels. Each pixel is controlled by the proper selection of row and column electrodes. A pixel is addressed when pulses traveling along the electrodes arrive at the same junction. An initial bias voltage may also be placed across the entire cell to control the overall transmission of the LCD. Thus, the average amount of light power falling on the semiconductor mask can be adjusted.

The update rate of the LCDs used for television is normally based on the composition of the video frame. A single video frame consists of two interlaced fields, with the entire field updated at a 60 Hz frame rate. If, instead of a composite video signal, the LCD is addressed with a full field video signal, a 60 Hz update rate is produced. Researchers at the University of Colorado at Boulder recently demonstrated a 1 kHz frame rate LCD[(2)].

For a 1-D scanning design, a linear LCD array that is available from "In Focus System", Tualatin, Oregon can be used. The LCD characteristics of this preferred linear LCD array are:

Drive System: Active matrix thin film transistor (TFT)

Number of Pixels: 1024 or 2048

Contrast Ratio: 100:1

Size: Up to 15"

Input Terminal: Analog video input Digital video input

These parameters are sufficient to generate the light-induced pattern required for the antenna, The SLM transmission is controlled by an applied voltage from a controlling computer[(9)].

Although the basic process of antenna fabrication in this task does not require special techniques, there are some fabrication issues that can strongly affect the antenna's performance. Specifically, to obtain low losses in the millimeter wavelength band, the silicon waveguide should be fabricated from highly resistive silicon crystal with a high carrier lifetime. Resistivity in the range of 15 to 30 ohm cm is common for both MOS and bipolar ICS, but this material is not appropriate for millimeter wavelength applications. High resistivity wafers are needed to produce high power semiconductor devices. These wafers are fabricated primarily by the float zone technique. Czochralski grown crystals often cannot meet the high resistivity specification because of the presence of oxygen donors. Float zone crystals have higher resistivity and the highest attainable carrier lifetime in silicon. Both properties are necessary for the antenna.

Conveniently, the photoconductive material of the present invention can be made of any material that is semiconductive. For the manufacturing operation, it is moreover an advantage to employ an intrinsic semiconductive material such as, for example, silicon.

Conveniently, the fabrication of the waveguide of the present invention can be carried out by using any semiconductor manufacturing method. For the manufacturing operation, it is moreover an advantage to employ a float zone method.

While not being limited to any particular embodiment, preferred embodiments of the present invention can be identified one at a time by testing for high gain, well defined beam pattern and high scanning rate. The testing for high gain, well defined beam pattern and high scanning rate can be carried out without undue experimentation by the use of simple and somewhat conventional bench top experiments.

Figure 6:
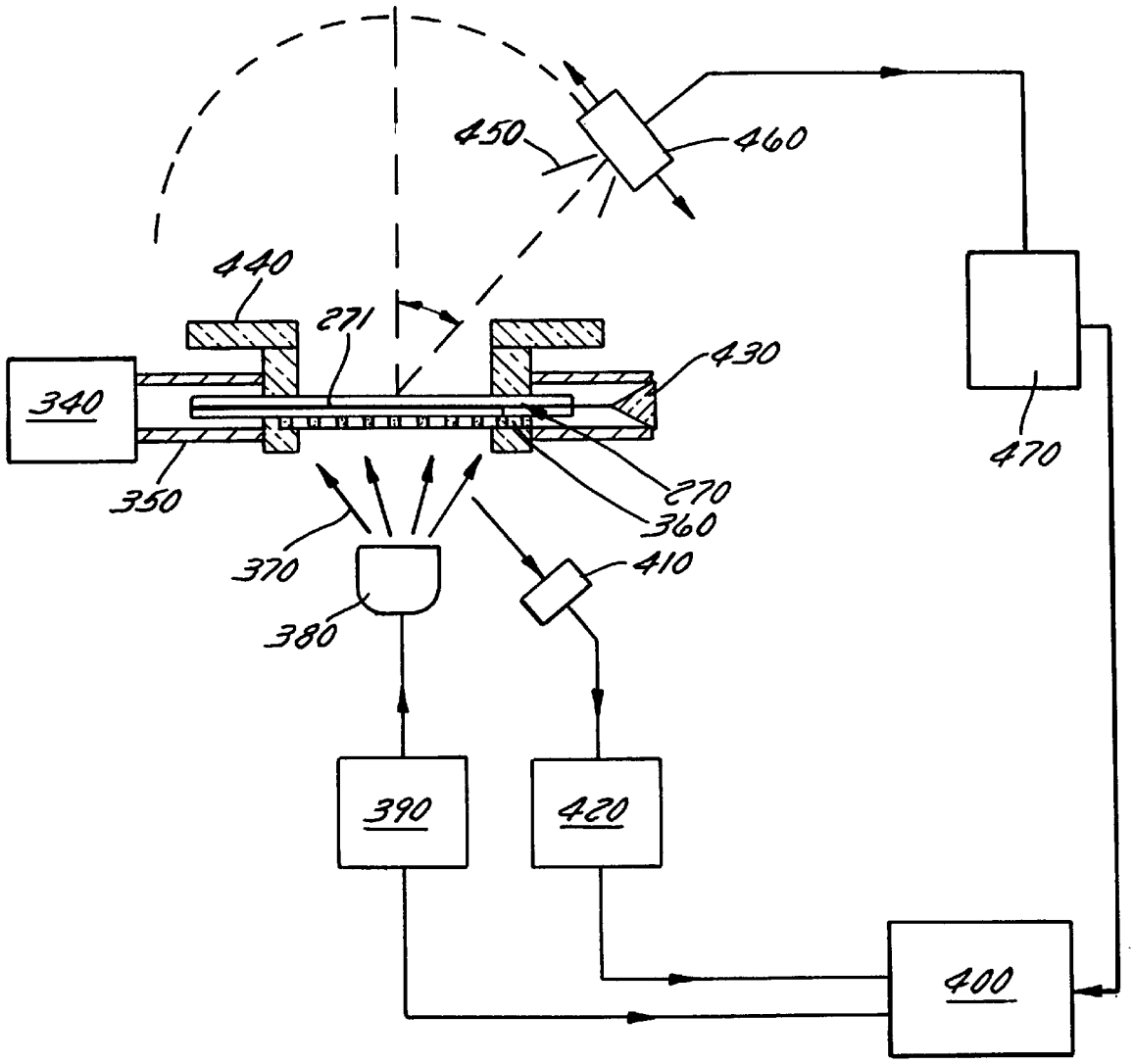
FIG. 6 illustrates a schematic view of a preferred configuration for testing and evaluating an optically controlled antenna system according to the present invention.

Referring now to FIG. 6, a schematic view of a exemplar preferred configuration for testing and evaluating an optically controlled antenna system according to the present invention is shown. Millimeter wavelength transmitter-receiver 340, is connected to gold doped silicon slab 270, which is a dielectric nonphotoconductive layer, with metal waveguide 350. Grating carrier 360 functions Photosensitive silicon layer 271 is adjacent dielectric nonphotoconductive layer 270. Crating carrier 360, which is a spatial light modulator, is adjacent photosensitive silicon layer 271 and acts to impose a photoinduced grating in photosensitive silicon layer 271, by screening pumping light 370. Flashlight source 380 is powered by pulse power source 390 which is also connected to a oscilloscope 400. A certain amount of pumping light 370, from flashlight source 380, is reflected from grating carrier 360 and detected by reference photo diode 410. Signals from reference photo diode 410 travel to amplifier 420 and then to oscilloscope 400. The end of silicon slab 270 that is not connected to metal waveguide 350, is plugged with papered resistive absorber 430. Silicon slab 270, is partially surrounded by absorber material 440, in order to reduce scattering. Millimeter wavelength beams travel from horn antenna 450, to silicon slab 270. Horn antenna 450 is connected to millimeter wavelength Gunn oscillator 460. Millimeter wavelength Gunn oscillator 460, is connected to amplifier 470. Amplifier 470, is connected to oscilloscope 400. The angular position of millimeter wavelength Gunn oscillator 460, is variably positionable with regard to the normal of silicon slab 270. The 3-D beam width of the tapered horn antenna 450, is approximately 6°. Therefore, by changing the period of grating carrier 360, various angular positions of radiation from the millimeter wavelength source can be detected by the experimental configuration.

Of course, the layered composite of nonphotoconductive layer 270 and photosensitive silicon layer 271 can be replaced by a monolithic, entirely photoconductive/photosensitive silicon slab waveguide. Similarly, the spatial light modulator can be replaced with a simple grating.

The foregoing descriptions of preferred embodiments are provided by way of illustration. Practice of the present invention is not limited thereto and variations therefrom will be readily apparent to those of ordinary skill in the art without deviating from the spirit and scope of the underlying inventive concept. For example, performance could be enhanced by providing a large surface area waveguide. In addition, although silicon is preferred for use as the semiconductor, any other suitable semiconductor, such as gallium arsenide, could be used in its place. Finally, the individual components need not be constructed of the disclosed materials or be formed in the disclosed shapes, but could be provided in virtually any configuration which employs periodic perturbations of the complex dielectric permittivity so as to provide coupling.

EXAMPLE

A specific embodiment of the present invention will now be further described by the following, nonlimiting example which will serve to illustrate various features of significance. The example is intended merely to facilitate an understanding of ways in which the present invention may be practiced and to further enable those of skill in the art to practice the present invention. Accordingly, the example should not be construed as limiting the scope of the present invention.

As illustrated in Table I (set forth below), the present invention can be advantageously utilized to provide a crash avoidance system antenna.

TABLE I

Crash Avoidance System GAIL parameters

| Parameter | Goal | Acceptable |
|---|---|---|
| Operating Frequency | 76.5 ± GHz | — |
| FM Bandwidth | 180 MHz | — |
| RF Power Handling Capability | 16 dBm min | — |
| Boresight Position | | |
| Azimuth | Normal to Array Plane | ±10° |
| Elevation | Normal to Array Plane | ±5° |
| Steering Direction | Azimuth (long axis) | — |
| Steering Angular Coverage | ±7.5° wrt Boresight | — |
| Elevation Boresight Deviation | ±0.5° max | — |
| Az −3 dB Beamwidth | 1.55° ± 0.05° at Boresight | — |
| El −3 dB Beamwidth | 3.00 ± 0.05° at Boresight | — |
| Az −25 dB Beamwidth | 3.20 ± 0.05° at Boresight | — |
| Sidelobe Level | | |
| Azimuth | −25 dB max | — |
| Elevation | −25 dB max | — |
| Polarization | Horiz or Vert Linear | — |
| Gain (at $R_x$ input) | 35 dB min | — |
| Beam Position Setting Time | 10 μsec max | — |
| Beam Position Jitter | 0.1° peak max | — |
| Size | 4 in. H × 7 in. W × 1 in. D | — |
| Waveguide Interface | | |
| Band | W-Band | — |
| Type | WR10 | — |

It can be seen from Table I that the effect of the present invention is to provide high performance in a compact package. Therefore, a practical application of the present invention which has value within the technological arts is in a collision avoidance system for aircraft or automobiles. All the disclosed embodiments are useful in conjunction with antenna systems such as are used for the purpose of transmitting and/or receiving electromagnetic signals, such as, for example, millimeter wavelength radiation signals, for the purpose of, for example, providing an inexpensive automobile, or aircraft, crash avoidance system, or the like. There are virtually innumerable uses for the present invention described herein, all of which need not be detailed here.

The present invention described herein provides substantially improved results that are unexpected. All the disclosed embodiments can be realized using conventional materials, components and subcombinatorial procedures without undue experimentation. The entirety of everything cited above or below is hereby expressly incorporated by reference.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

For example, performance could be enhanced by providing better light sources, reflectors and spatial light modulators. Similarly, although ITO is preferred for the antireflection material, any suitable material could be used in its place. In addition, the individual components need not be fabricated from the disclosed materials, but could be fabricated from virtually any suitable materials.

Moreover, the individual components need not be formed in the disclosed shapes, or assembled in the disclosed configuration, but could be provided in virtually any shape, and assembled in virtually any configuration, that induces a suitable grating so as to provide evanescent coupling. Further, although the antenna described herein is a physically separate module, it will be manifest that the antenna may be integrated into the apparatus with which it is associated. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended subclaims.

REFERENCES

1. WFFB, "Millimeter-Wave Technology Application for Automobiles" IEEE MTT-S, International Microwave Symposium, San Diego (May 27, 1994).
2. Litton Solid State, Santa Clara Calif., Commercial Brochure (1994).
3. C. H. Lee, P. S. Mak, and A. P. Defonzo, "Optical control of millimeter-wave propagation in dielectric waveguides," IEEE J. Quantum Electron., vol. QE-16, pp. 277–288 (March 1980).
4. K. Ogusu, I. Tanka, and H. Itoh, "Propagation properties of dielectric waveguides with optically induced plasma layers," Trans. IECE Japan, vol. J66-C, pp. 39–46 (January 1983).
5. M. Matsumoto, M. Tsutsumi, and N. Kunagi, "Bragg Reflection Characteristics of MMW in Periodic Plasma Induced Semiconductor Waveguide," IEEE Transactions on Microwave Theory and Techniques, MIT-34, N4, pp. 406–411 (1986).
6. M. Matsumoto, M. Tsutsumi, and N. Kunnagai, "Radiation Characteristics of Dielectric Slab Waveguide Periodically Loaded with Thick Metal Strips," IEEE Transaction Microwave Theory and Techniques, MTT-35, (2), pp. 89–95 (February 1987).
7. Hotta, S., M. Kto, and K. Kawoi. "Generation of High Quality Holograms with Liquid Crystal SLM," SPIE Proceedings, Volume 1212, pp. 93–101 (1990).
8. P. Bhartia and I. J. Bahl, Millimeter Wave Engineering and Applications, Wiley, N.Y., 1984.

9. Seiler, Milton R. and Mathena, Bill M., "Millimeter-Wave Beam Steering Using Diffraction Electronics," IEEE Transactions on antennas and Propagation, Vol. AP-32, No. 9, (September 1984).
10. R. Tribe, et al., "MM-Wave Radar for Advanced Intelligent Cruise Control Applications," SPIE Vol. 2250.
11. Jain, Atul, "Antenna Technology for Millimeter-Wave Applications in Automobiles," Hughes Radar Systems, (May 1994).
12. M. Guglielmi and A. A. Oliner, "A Practical Theory for Dielectric Image Guide Leaky-Wave Antennas Loaded by Periodic Metal Strips," pp. 549–552.
13. Van Nostrand's Scientific Encyclopedia, 8th ed., Van Nostrand Reinhold, (Douglas M. Considine et al. eds., 1995).
14. The Electrical Engineering Handbook, CRC Press, (Richard C. Dorf et al. eds., 1993).
15. Handbook of Optics, 2nd ed., Vols. I–II, McGraw Hill, (Michael Bass et al. eds., 1995).
16. Radar Handbook, 2nd ed., McGraw Hill, (Merrill I. Skolnik ed., 1990).

What is claimed is:

1. A guided wave antenna comprising:

a dielectric nonphotoconductive waveguide defining a principal axis;

a grating carrier connected to said dielectric nonphotoconductive waveguide, said grating carrier i) including a photoconductive material and ii) defining a photoconductive axis that is substantially parallel to said principal axis;

a spatial light modulator optically connected to said grating carrier of photoconductive material; and a source of illumination optically connected to said spatial light modulator and said grating carrier of photoconductive material, wherein light from said source of illumination passes through said spatial light modulator and induces a plasma grating in said grating carrier substantially along a direction defined by said photoconductive axis so as to evanescently couple and direct electromagnetic signals traveling in said dielectric nonphototonductive waveguide, said electromagnetic signals traveling along a direction substantially parallel to said principal axis.

2. The apparatus of claim 1 further comprising a detector connected to said dielectric nonphotoconductive waveguide so as to receive said electromagnetic signals from said dielectric nonphotoconductive waveguide.

3. The apparatus of claim 1 further comprising a signal source connected to said dielectric nonphotoconductive waveguide so as to transmit said electromagnetic signals into said dielectric nonphotoconductive waveguide.

4. The apparatus of claim 1 wherein said source of illumination includes a light emitting diode array.

5. The apparatus of claim 1 wherein said dielectric nonphotoconductive waveguide is substantially transparent to transmission of millimeter wavelength electromagnetic signals.

6. The apparatus of claim 1 wherein said dielectric nonphotoconductive waveguide is a planar waveguide.

7. A method comprising:

providing a guided-wave antenna with:

a) a dielectric nonphotoconductive waveguide defining a principal axis;

b) a grating carrier connected to said dielectric nonphotoconductive waveguide, said grating carrier i) including a photoconductive material and ii) defining a photoconductive axis that is substantially parallel to said principle axis;

c) a spatial light modulator optically connected to said grating carrier of photoconductive material; and d) a source of illumination optically connected to said spatial light modulator and said grating carrier of photoconductive material; and illuminating said grating carrier with light from said source of illumination that passes through said spatial light modulator so as to induce a plasma grating in said grating carrier substantially along a direction defined by said photoconductive axis, said plasma grating having a period;

evanescently coupling electromagnetic signals traveling in said dielectric nonphotoconductive waveguide, said electromagnetic signals traveling substantially along a direction defined by said principal axis; and directing electromagnetic signals traveling in said dielectric nonphotoconductive waveguide.

8. The method of claim 7 wherein said electromagnetic signals include millimeter wavelength signals.

9. The method of claim 7 further comprising modulating said spatial light modulator so as to scan said antenna by changing said period.

10. A guided wave antenna comprising:

a photoconductive waveguide defining a principal axis;

a spatial light modulator optically connected to said photoconductive waveguide; and a source of illumination optically connected to said spatial light modulator and said photoconductive waveguide, wherein light from said source of illumination passes through said spatial light modulator and induces a plasma grating in said photoconductive waveguide along a direction substantially parallel to said principal axis so as to evanescently couple and direct electromagnetic signals traveling in said photoconductive waveguide, said electromagnetic signals traveling along a direction substantially parallel to said principal axis.

11. The apparatus of claim 10 further comprising a detector connected to said photoconductive waveguide so as to receive said electromagnetic signals from said photoconductive waveguide.

12. The apparatus of claim 10 further comprising a signal source connected to said photoconductive waveguide so as to transmit said electromagnetic signals into said photoconductive waveguide.

13. The apparatus of claim 10 wherein said source of illumination includes a light emitting diode array.

14. The apparatus of claim 10 wherein said photoconductive waveguide is substantially transparent to transmission of millimeter wavelength electromagnetic signals.

15. The apparatus of claim 10 wherein said photoconductive waveguide is a planar waveguide.

* * * * *

UNITED STATES PATENT AND TRADEMARK OFFICE

CERTIFICATE OF CORRECTION

PATENT NO. : 5,886,670

DATED : Mar. 23, 1999

INVENTOR(S) : Manasson et al.

It is certified that error appears in the above-identified patent and that said Letters Patent is hereby corrected as shown below:

On the cover page of the patent, in the Abstract, line 18, after "the" delete "principle" and insert --principal--.

Col. 2, line 62, after the first "and" insert $i=\sqrt{-1}$

Col. 5, line 9, delete "principle" and insert --principal--.

Col. 5, line 18, delete "principle" and insert --principal--.

Col. 5, line 21, delete "principle" and insert --principal--.

Col. 5, line 36, delete "principle" and insert --principal--.

Col. 5, line 40, delete "principle" and insert --principal--.

Col. 5, line 52, delete "principle" and insert --principal--.

Col. 7, line 22, delete "principle" and insert --principal--.

Col. 9, line 40, delete "affect" and insert --effect--.

Col. 12, line 32, delete "Grating carrier 360 functions".

Col. 12, line 34, delete "Crating" and insert --Grating--.

Col. 16, line 7, delete "principle" and insert --principal--.

UNITED STATES PATENT AND TRADEMARK OFFICE

CERTIFICATE OF CORRECTION

PATENT NO. : 5,886,670
DATED : Mar. 23, 1999
INVENTOR(S) : Manasson, et. al.

It is certified that error appears in the above-identified patent and that said Letters Patent is hereby corrected as shown below:

Col. 16, 25, after "directing" insert --said--.

Signed and Sealed this

Twenty-fourth Day of August, 1999

*Attest:*

Q. TODD DICKINSON

*Attesting Officer*

*Acting Commissioner of Patents and Trademarks*